US008905664B2

(12) United States Patent
Kumai

(10) Patent No.: US 8,905,664 B2
(45) **Date of Patent: *Dec. 9, 2014**

(54) CUTTER DEVICE AND RECORDING APPARATUS

(71) Applicant: Seiko Epson Corporation, Tokyo (JP)

(72) Inventor: Eiji Kumai, Hata-machi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/939,318

(22) Filed: Jul. 11, 2013

(65) Prior Publication Data

US 2013/0302077 A1 Nov. 14, 2013

Related U.S. Application Data

(63) Continuation of application No. 12/400,941, filed on Mar. 10, 2009, now Pat. No. 8,500,350.

(30) Foreign Application Priority Data

Mar. 11, 2008 (JP) ..... 2008-060996

(51) Int. Cl.

| | |
|---|---|
| ***B41J 13/24*** | (2006.01) |
| ***B26D 1/24*** | (2006.01) |
| ***B41J 11/00*** | (2006.01) |
| ***B41J 11/66*** | (2006.01) |
| ***B41J 11/70*** | (2006.01) |
| *B26D 7/32* | (2006.01) |

(52) U.S. Cl.

CPC . *B41J 11/66* (2013.01); *B26D 7/32* (2013.01); *B26D 1/245* (2013.01); *B41J 11/001* (2013.01); *B41J 11/706* (2013.01)

USPC ..... 400/621; 400/611

(58) Field of Classification Search

USPC ..... 400/621

See application file for complete search history.

(56) References Cited

U.S. PATENT DOCUMENTS

| | | | |
|---|---|---|---|
| 5,042,349 | A | 8/1991 | Komatsu |
| 5,791,218 | A | 8/1998 | Saito et al. |

(Continued)

FOREIGN PATENT DOCUMENTS

| | | |
|---|---|---|
| CN | 101088770 | 12/2007 |
| GB | 2 29 9778 | 10/1996 |

(Continued)

OTHER PUBLICATIONS

U.S. Appl. No. 12/400,941, Mail Date Aug. 1, 2012, Office Action.

(Continued)

*Primary Examiner* — Michael G Lee
*Assistant Examiner* — Matthew Mikels
(74) *Attorney, Agent, or Firm* — Workman Nydegger

(57) ABSTRACT

A cutter device includes: a first cutter provided on a front surface side of a medium being fed to be cut; a second cutter that is provided on a back surface side opposite the front surface side and cuts the medium in cooperation with the first cutter; a carriage that retains the first and second cutters and moves in a width direction of the medium; a guide portion that guides the carriage in the width direction; and a post-cut guide portion that is provided on the carriage and comes into contact with the back surface to guide the medium on the downstream side of the first and second cutters in a medium feed direction after cutting to the front surface side.

16 Claims, 10 Drawing Sheets

(56) References Cited

U.S. PATENT DOCUMENTS

| | | | | |
|---|---|---|---|---|
| 5,937,723 | A | 8/1999 | Kirikoshi et al. | |
| 6,807,888 | B1 | 10/2004 | Kiyohara et al. | |
| 8,500,350 | B2 * | 8/2013 | Kumai | 400/621 |
| 2001/0000463 | A1 | 4/2001 | Kaya | |
| 2003/0010169 | A1 | 1/2003 | Nagasawa | |
| 2005/0207818 | A1 | 9/2005 | Tsuchiya et al. | |
| 2006/0007292 | A1 | 1/2006 | Ohmori et al. | |
| 2006/0162524 | A1 | 7/2006 | Suzuki et al. | |
| 2008/0061491 | A1 | 3/2008 | Nakashima | |
| 2009/0226236 | A1 | 9/2009 | Yamashita et al. | |

FOREIGN PATENT DOCUMENTS

| | | |
|---|---|---|
| JP | 02-250793 | 10/1990 |
| JP | 06-198989 | 7/1994 |
| JP | 07-024782 | 1/1995 |
| JP | 07-100791 | 4/1995 |
| JP | 08-150593 | 6/1996 |
| JP | 08-174472 | 7/1996 |
| JP | 09-019888 | 1/1997 |
| JP | 09-117891 | 5/1997 |
| JP | 09-254083 | 9/1997 |
| JP | 10-109292 | 4/1998 |
| JP | 2000-158735 | 6/2000 |
| JP | 2000-158738 | 6/2000 |
| JP | 2001-071293 | 3/2001 |
| JP | 2003-025661 | 1/2003 |
| JP | 2003-103495 | 4/2003 |
| JP | 2003-260830 | 9/2003 |
| JP | 2003-266832 | 9/2003 |
| JP | 2004-122676 | 4/2004 |
| JP | 2004-202628 | 7/2004 |
| JP | 2005-219178 | 8/2005 |
| JP | 2005-238785 | 9/2005 |
| JP | 2006-168154 | 6/2006 |
| JP | 2006-198739 | 8/2006 |
| JP | 2007-022070 | 2/2007 |

OTHER PUBLICATIONS

U.S. Appl. No. 12/400,941, Mail Date Dec. 12, 2012, Final Office Action.

U.S. Appl. No. 12/400,941, Mail Date Apr. 11, 2013, Notice of Allowance.

* cited by examiner

CUTTER DEVICE AND RECORDING APPARATUS

This application is a Continuation of U.S. patent application Ser. No. 12/400,941 filed Mar. 10, 2009 which claims priority to Japanese Patent Application No. 2008-060996, filed Mar. 11, 2008, which applications are expressly incorporated by reference herein.

BACKGROUND

1. Technical Field

The present invention relates to a cutter device including a first cutter provided on a front surface side of a medium being fed to be cut, a second cutter that is provided on a back surface side opposite the front surface side and cuts the medium in cooperation with the first cutter, a carriage that retains the first and second cutters and moves in a width direction of the medium, and a guide portion that guides the carriage in the width direction, and also relates to a recording apparatus having the cutter device.

Herein, the "recording apparatus" includes an ink jet printer, a wire dot printer, a laser printer, a line printer, a copier, a facsimile, etc.

2. Related Art

As disclosed in JP-A-2005-219178 and JP-A-9-117891, a recording apparatus in which a rolled sheet can be set includes a cutting section serving as a cutter device. The cutting section includes a cutter motor serving as a driving source, a cutter holder that moves in a width direction of the rolled sheet, and a guide rail that guides the cutter holder in the width direction. The cutter holder includes two cutters for cutting the rolled sheet.

Thus, after a user sets the rolled sheet, the rolled sheet can be cut before recording and after recording.

However, when the rolled sheet is cut, the cutter holder is brought into surface-contact with the front surface (top surface) of the rolled sheet on the downstream side after cutting and pushes it downward. This can damage the front surface of the rolled sheet.

SUMMARY

An advantage of some aspects of the invention is that it provides a cutter device that will not damage the front surface of the medium after cutting, and a recording apparatus having the cutter device.

A cutter device according to a first aspect of the invention includes a first cutter provided on a front surface side of a medium being fed to be cut, a second cutter that is provided on a back surface side opposite the front surface side and cuts the medium in cooperation with the first cutter, a carriage that retains the first and second cutters and moves in a width direction of the medium, a guide portion that guides the carriage in the width direction; and a post-cut guide portion that is provided on the carriage and comes into contact with the back surface to guide the medium on the downstream side of the first and second cutters in a medium feed direction after cutting to the front surface side.

According to the first aspect of the invention, the cutter device includes the post-cut guide portion. Thus, the post-cut guide portion can guide the medium on the downstream side of the first and second cutters in the medium feed direction after cutting to the front surface side by coming into contact with the back surface.

That is, the post-cut guide portion does not come into contact with the front surface of the medium after cutting. Accordingly, the front surface will not be damaged.

It is preferable that the first cutter be provided on an upstream side of the second cutter in the feed direction, and the second cutter be provided on a downstream side of the first cutter in the feed direction.

In this case, the first cutter is provided on the upstream side of the second cutter in the feed direction, and the second cutter is provided on the downstream side of the first cutter in the feed direction. This is effective because the medium on the downstream side after cutting tends to be displaced to the front surface side, and the medium after cutting, positioned on the upstream side, tends to be displaced to the back surface side. That is, the medium after cutting can be displaced to the front surface side using the force exerted on the medium by the second cutter. The post-cut guide portion can guide the medium after cutting in a direction in which the medium is displaced. Accordingly, the post-cut guide portion can smoothly guide the medium after cutting. In other words, no unnecessary friction resistance is generated between the post-cut guide portion and the medium after cutting.

It is preferable that the cutter device further include a suction portion that sucks the medium toward the back surface side at a position on the upstream side of the first and second cutters in the feed direction. In this case, the cutter device includes the suction portion that sucks the medium toward the back surface side at a position on the upstream side of the first and second cutters in the feed direction. In this case, the positional relationship between the first and second cutters is effective.

In the configuration in which the first and second cutters cut the medium in cooperation with each other, at the time of cutting, the medium positioned on the upstream side is subjected to a force directed toward one of the front surface side and the back surface side, and the medium positioned on the downstream side is subjected to a force directed toward the other of the front surface side and the back surface side when cut. Thus, one of the media positioned on the upstream side and the downstream side after cutting is subjected to a force causing it to be displaced to the front surface side.

By locating the first cutter, which is provided on the front surface side of the medium, on the upstream side of the second cutter in the feed direction, a force directed toward the back surface side is exerted on the medium on the upstream side. Because no force directed toward the front surface side is exerted, the suction operation of the suction portion is not blocked. Furthermore, because a force directed toward the suction portion side, i.e., the back surface side, is exerted, the suction operation of the suction portion can be promoted. Thus, the accuracy of the medium cutting position improves, and thus, this structure is effective.

It is preferable that the first and second cutters be round blades, and the first cutter be driven by the movement of the carriage.

In this case, the first and second cutters are round blades, and the first cutter is driven by the movement of the carriage. Accordingly, the medium to be cut is caused to mesh with the first and second cutters, whereby the friction between the front surface of the medium and the first cutter during driving can be reduced.

It is preferable that the guide portion be provided on the front surface side.

In this case, the guide portion is provided on the front surface side.

Herein, the front surface side is the upper side in the vertical direction. If the guide portion is provided on the lower side, i.e., the back surface side of the medium to be cut, the dust produced during cutting of the medium can adhere to the guide portion. This may reduce the durability.

In this case, the guide portion is provided on the upper side, which is the front surface side of the medium to be cut. Thus, if dust is generated during cutting, the dust will not adhere to the guide portion. Accordingly, the durability will not be reduced.

It is preferable that the cutter device further include auxiliary rollers provided on the upstream and downstream sides of the guide portion in the feed direction, which can come into contact with the medium and rotated in a driven manner.

In this case, the cutter device includes the auxiliary rollers provided on the upstream and downstream sides of the guide portion in the feed direction, which can come into contact with the medium and rotated in a driven manner. Thus, the medium subjected to cutting can be prevented from becoming loose. As a result, the medium can be more accurately cut at a predetermined position, and thus, the accuracy of the cutting position can be improved. This is especially effective when the medium to be cut is curved due to its having been rolled up.

Furthermore, by providing the auxiliary rollers, a user will not touch the guide portion. Thus, the safety can be improved.

It is preferable that the carriage include a pre-cut guide portion that guides the medium subjected to cutting to a cutting point where the first and second cutters overlap each other.

Herein, the term "cutting point" refers to a point at the downstream end of a region where the two cutters overlap each other in a traveling direction of the cutters.

In this case, the carriage includes the pre-cut guide portion that guides the medium subjected to cutting to the cutting point where the first and second cutters overlap each other. Thus, the accuracy of the cutting position improves.

Furthermore, by gradually narrowing the pre-cut guide portion, a user can be prevented from directly touching the first and second cutters. Thus, the safety can be improved.

A recording apparatus according to a second aspect of the invention includes a feed section that feeds a recording medium; a recording section that executes recording on the recording medium fed from the feed section with a recording head; and a cutting section that cuts the recording medium after recording. The cutting section includes the above-described cutter device.

According to the second aspect of the invention, the cutting section includes the above-described cutter device. Thus, the recording apparatus can provide the same advantages as the first aspect.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments of the invention will be described below with reference to the drawings.

Figure 1:
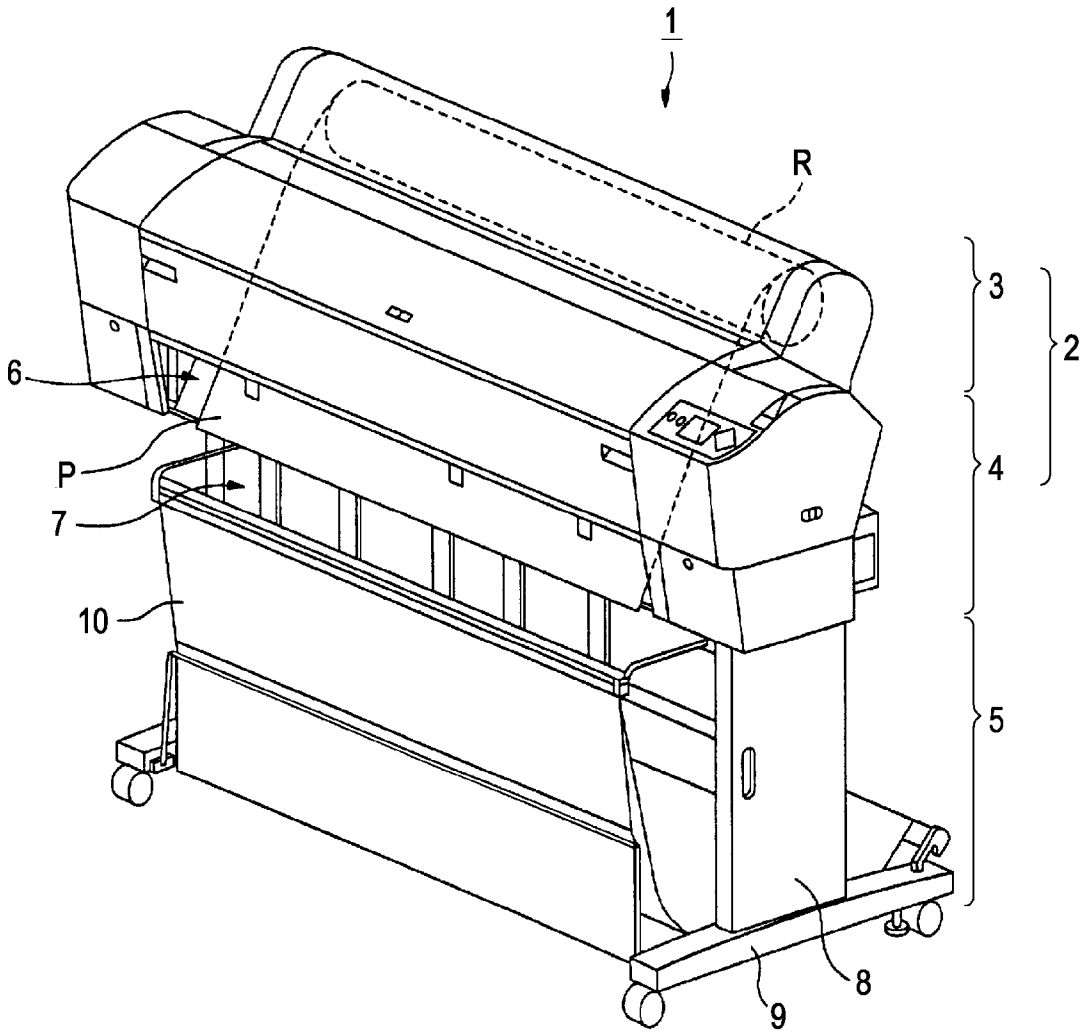
FIG. 1 is an external perspective view of a printer of the invention.
Figure 2:
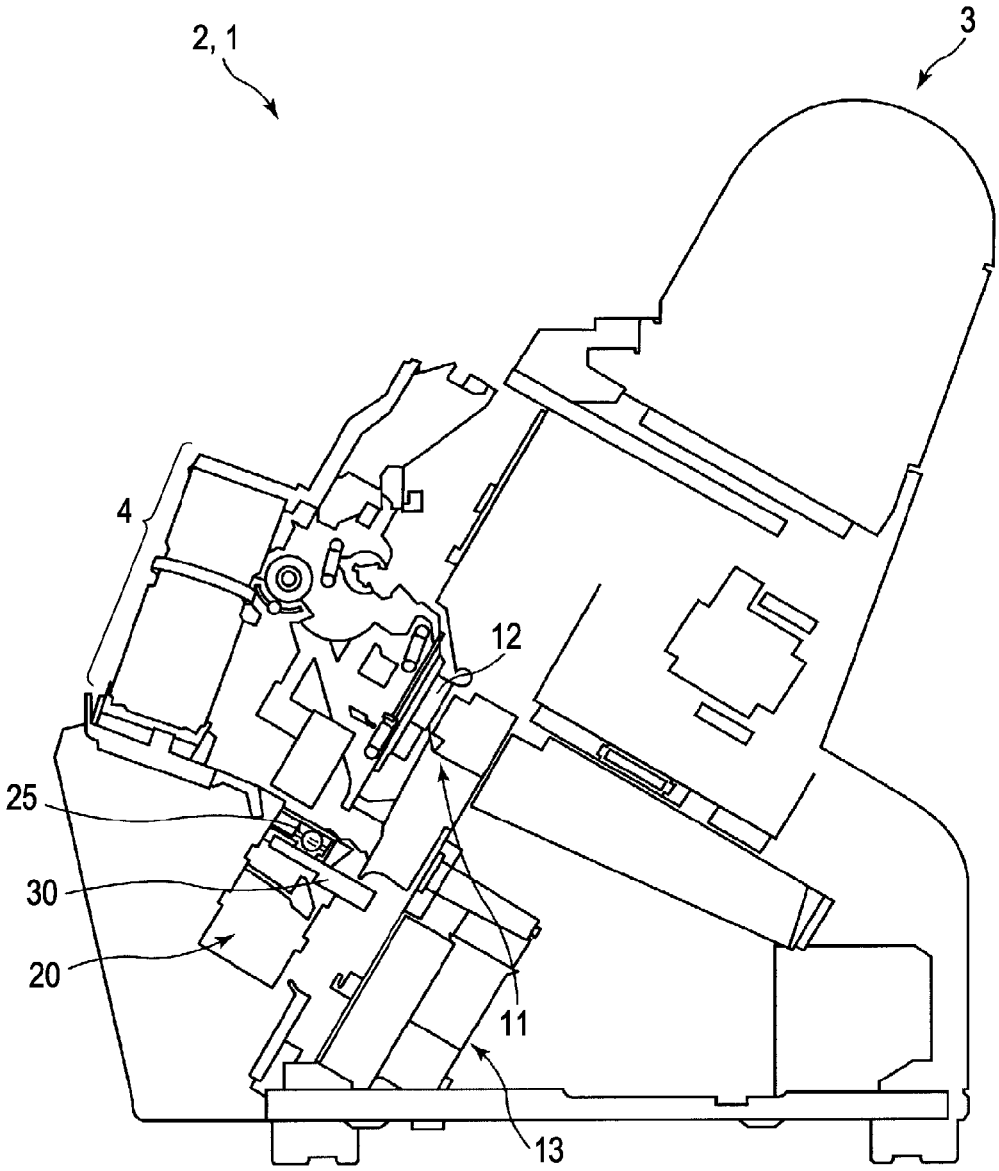
FIG. 2 is a schematic side view of a printer main body of the invention.

FIG. 1 is an external perspective view of an ink jet printer (hereinafter, "printer ") 1 of the invention, which is an example of a recording apparatus or a liquid ejecting apparatus. FIG. 2 is a schematic side view of a printer main body of the invention.

Herein, the term "liquid ejecting apparatus" refers not only to a recording apparatus (e.g. an ink jet recording apparatus, a copier, and a facsimile) which ejects ink from a recording head, serving as a liquid ejection head, onto a recording medium (e.g., a recording sheet) to perform recording on the recording medium, but also to an apparatus which ejects a liquid used for a specific purpose, instead of ink, from a liquid ejection head corresponding to the recording head onto a liquid-receiving material corresponding to the recording medium to cause the liquid to be deposited on the liquid-receiving material.

Examples of the liquid ejection head include, in addition to the above-mentioned recording head, a color-material ejection head used in the production of color filters for liquid crystal displays, an electrode-material (conductive paste) ejection head used for forming electrodes of organic EL displays and field-emission displays (FEDs), a living-organic-material ejection head used in the production of biochips, and a sample ejection head serving as a precision pipette.

The printer 1 is a large printer capable of recording on a rolled sheet P, which serves as a receiving medium or a recording medium, having a relatively large width, for example, A0 size or B0 size (JIS standard). The printer 1 includes a main body 2, which consists of a rolled-sheet feed section 3 and a recording execution portion 4, and a discharged-sheet receiving portion 5.

The main body 2 is provided on legs 8 standing upright on bases 9, and has a discharge port 6 through which the recorded rolled sheet P is discharged diagonally downward. An opening portion 7 of a stacker 10 is positioned below the discharge port 6. The recorded rolled sheet P is discharged from the discharge port 6 toward the opening portion 7 and received by the stacker 10.

The rolled-sheet feed section 3 can accommodate a rolled-sheet roll (hereinafter, "roll") R. The rolled sheet P is drawn from the roll R and fed diagonally downward to the recording execution portion 4, where recording is executed. The roll R is set to the rolled-sheet holder (not shown). When the rolled-sheet P is fed, the rolled-sheet holder is rotated by a spindle motor (not shown) serving as a roll-driving unit. Thus, the rolled sheet P is fed toward the downstream side.

The recording execution portion 4 includes a recording head 12 (refer to FIGS. 2 to 4), serving as a liquid ejection unit or a recording unit, which discharges (ejects) ink, serving as liquid, onto the rolled sheet P, a platen 11 (refer to FIGS. 2 to 4) opposed to the recording head 12, a transportation driving roller (transportation roller) (not shown) that is provided on the upstream side of the recording head 12 and transports the rolled sheet P toward the downstream side, and a transportation driven roller (not shown) that is pressed against the transportation driving roller and rotated in a driven manner.

The recording head 12 is provided on the carriage (not shown). The carriage is powered by a motor (not shown) and moves in a scanning direction of the recording head 12 (main scanning direction) while being guided by a guide shaft (not shown) and a guide plate (not shown) extending in the main scanning direction.

An air suction unit 13 (refer to FIGS. 2 to 4), serving as a sheet suction portion, is provided on the downstream side of the recording head 12. The air suction unit 13 prevents the rolled sheet P from becoming loose at a position on the downstream side of the recording head 12. Thus, degradation in recording quality due to the rolled sheet P becoming loose is prevented.

Figure 3:
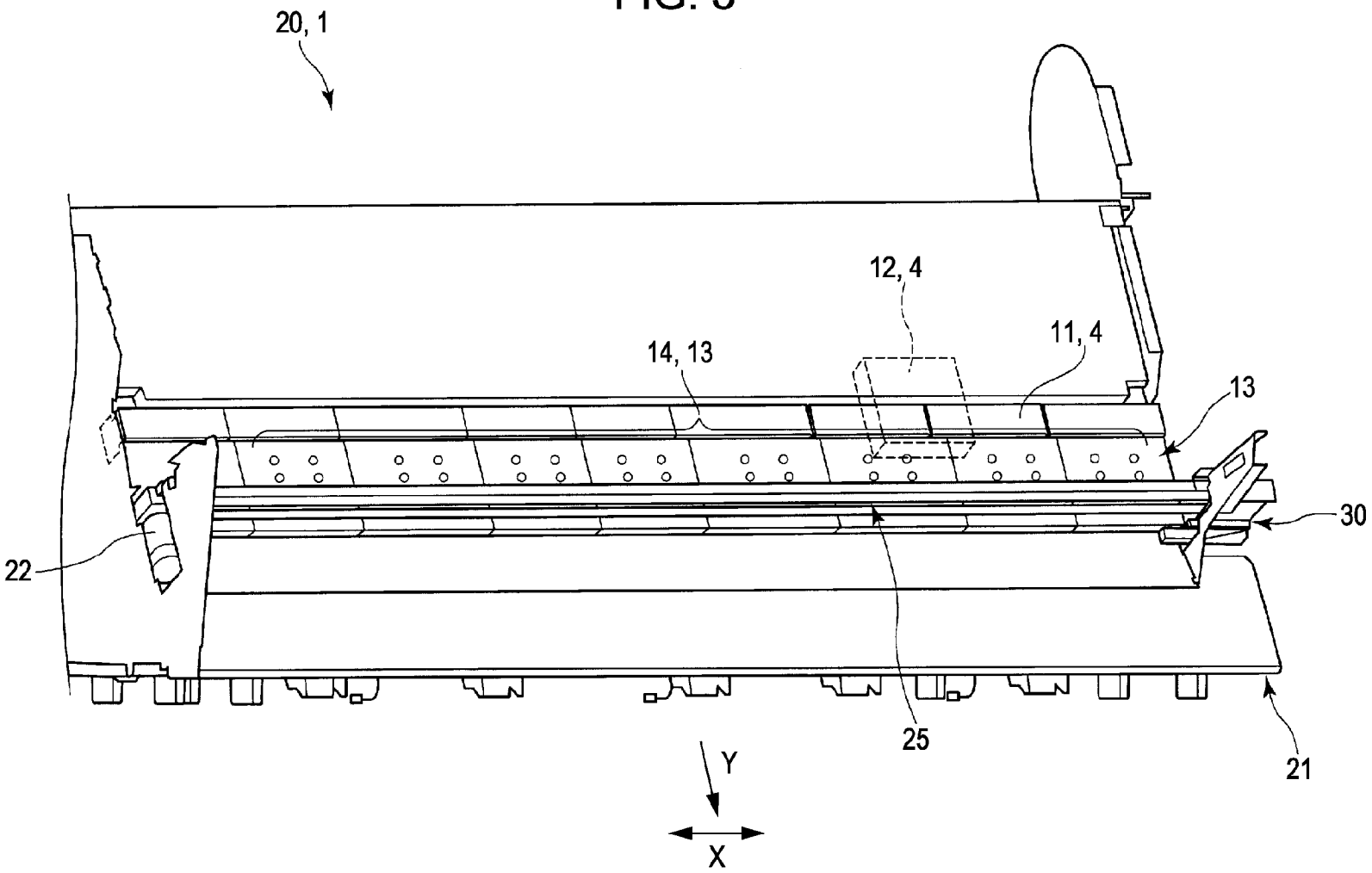
FIG. 3 is a schematic perspective view of a cutting section of the invention.
Figure 4:
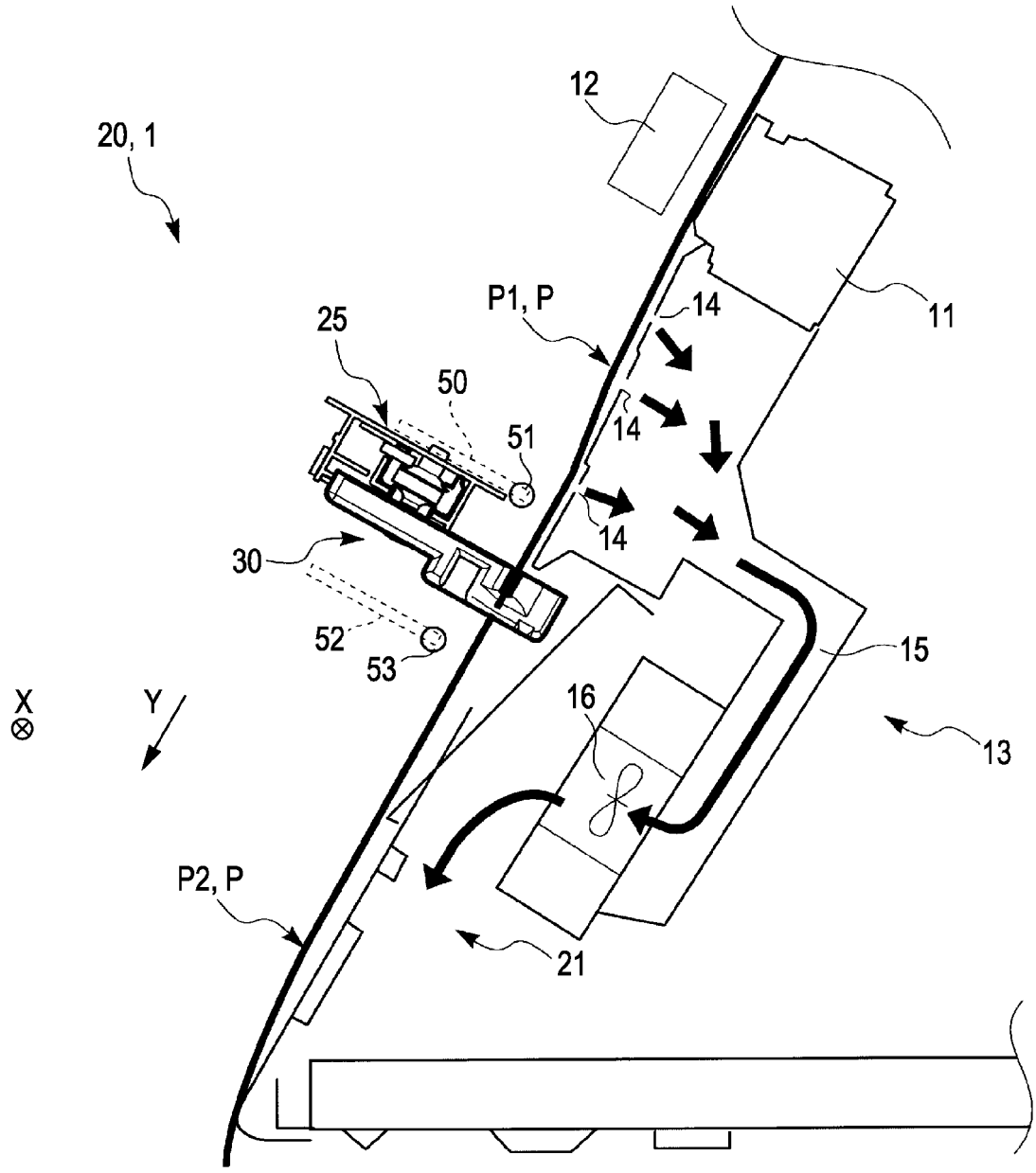
FIG. 4 is a schematic side view of the cutting section of the invention.
Figure 5:
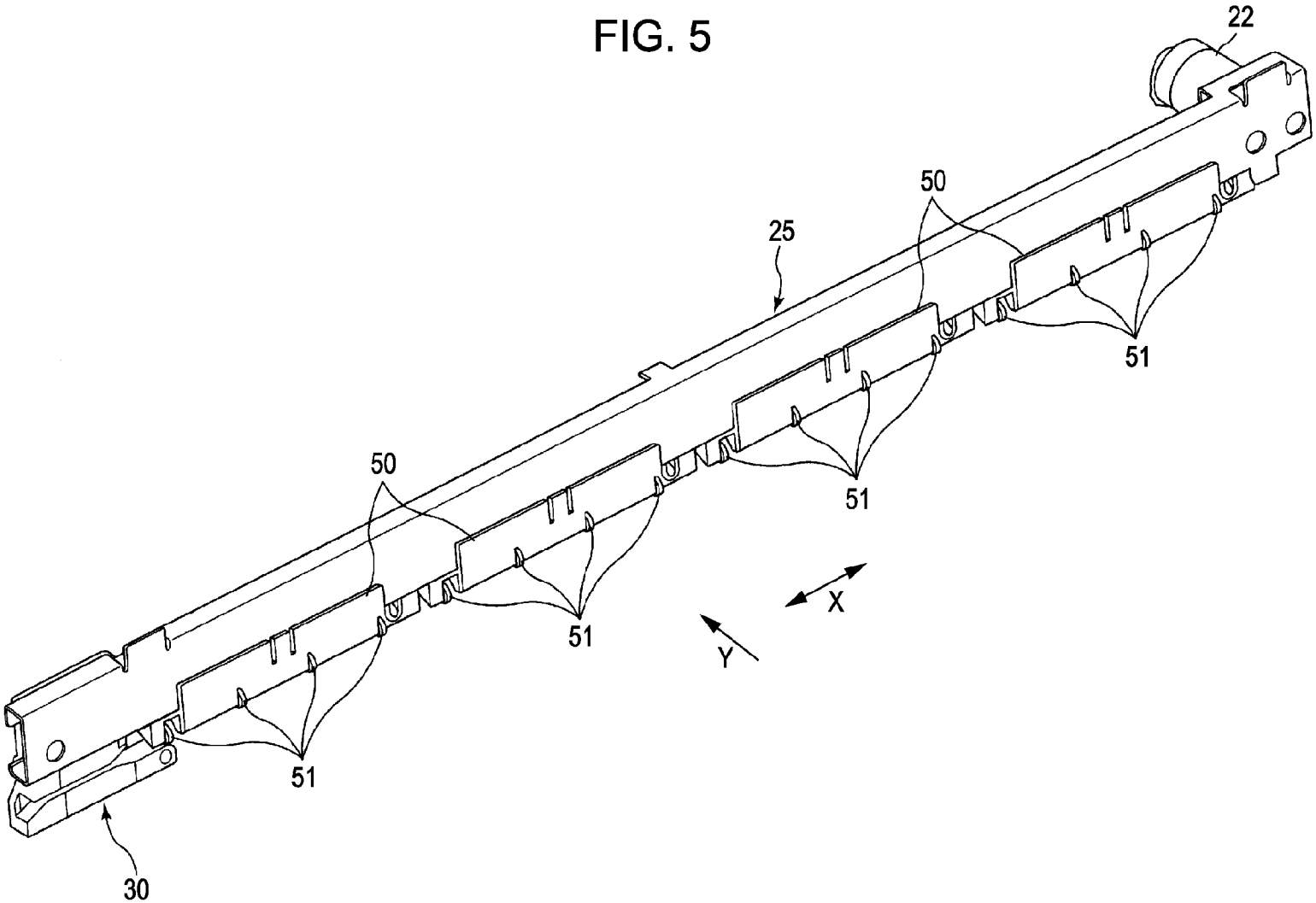
FIG. 5 is a rear perspective view of a guide rail of the cutting section of the invention.

FIG. 3 is a schematic perspective view of the cutting section of the invention. FIG. 4 is a schematic side view of the cutting section of the invention. FIG. 5 shows a rear perspective view of a guide rail 25 of the cutting section of the invention.

As shown in FIGS. 3 and 4, the recording execution portion 4 of the printer 1 has the platen 11. The air suction unit 13 and a cutting section 20 that cuts the rolled sheet P are provided on the downstream side of the platen 11 in the feed direction (direction indicated by the arrow Y).

The air suction unit 13 has a number of suction holes 14, a suction fan 16, and a suction tube 15, which connects the suction holes 14 and the suction fan 16, on the downstream side of the platen 11 in the feed direction. Negative pressure is generated in the suction tube 15 to suck the rolled sheet P toward the platen.

The cutting section 20 includes a base portion 21, a cutter motor 22, the guide rail 25, and a cutter unit 30.

Figure 6:
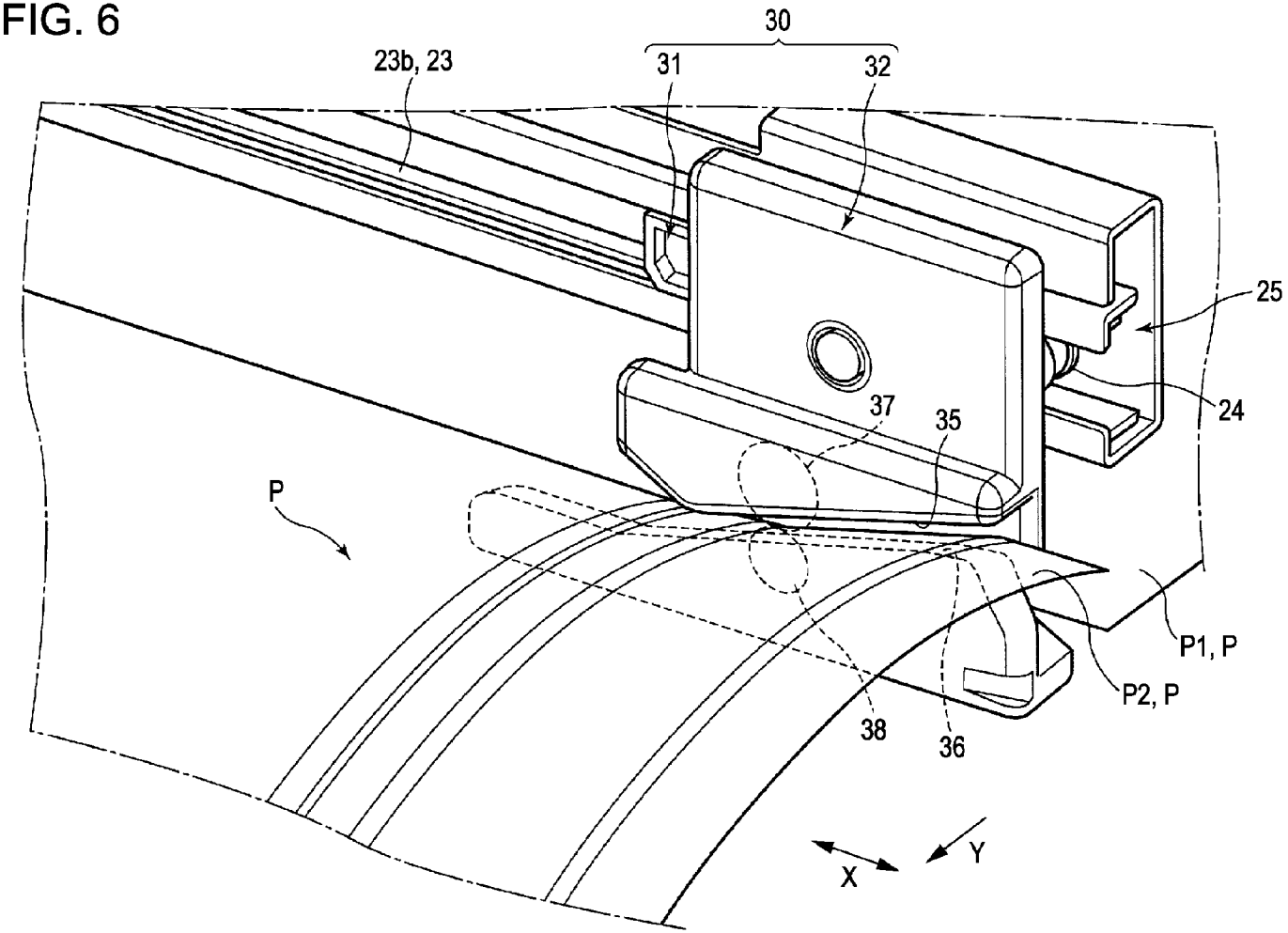
FIG. 6 is a perspective view showing the cutting section of the invention cutting a sheet.
Figure 9:
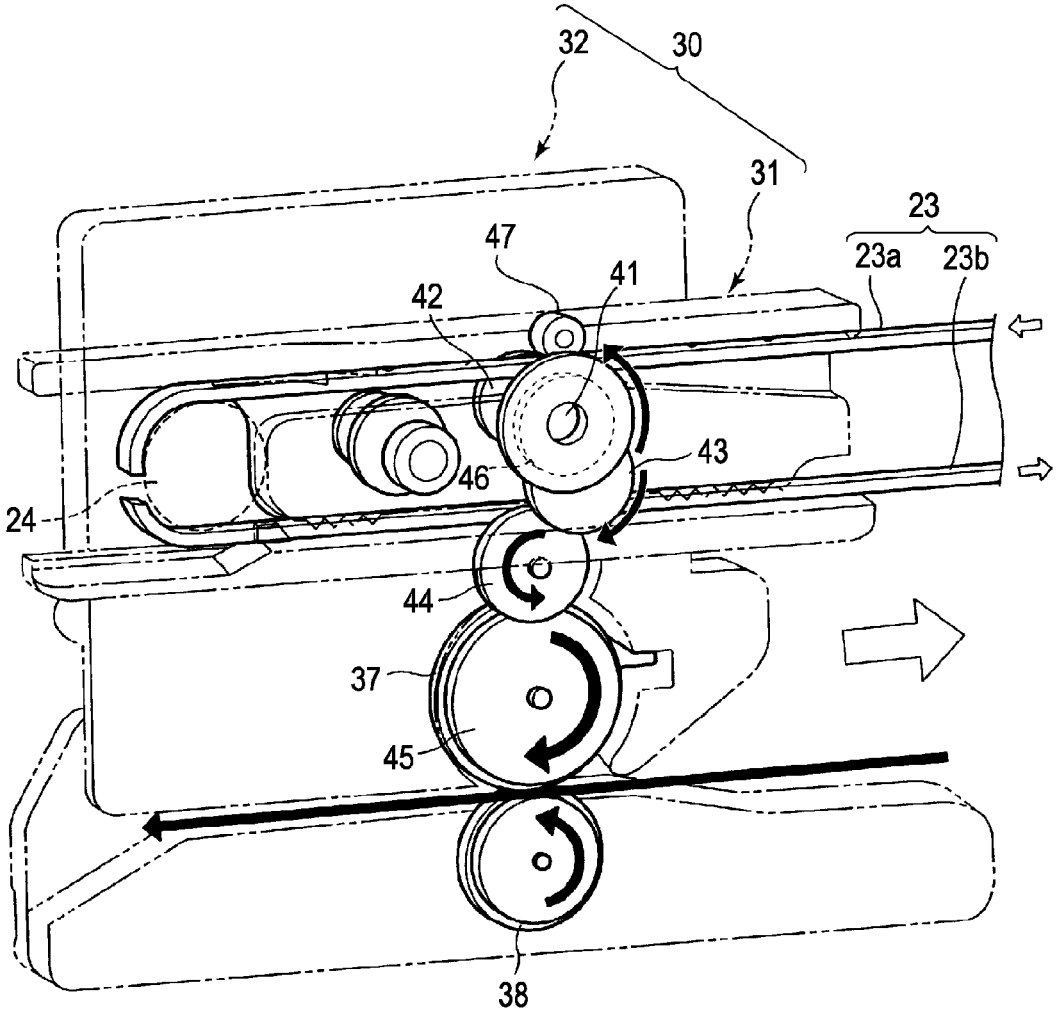
FIG. 9 shows power transmission to cutters of a cutter unit of the invention.

The cutter motor 22 is provided so as to be able to power the cutter unit 30 through an endless belt 23 (refer to FIGS. 6 and 9) wound around a driven pulley 24 (refer to FIGS. 6 and 9). The guide rail 25 is configured to guide the cutter unit 30 in a width direction X of the rolled sheet P.

Because the guide rail 25 is provided on the recording surface side, which is the front surface side of the rolled sheet P, the printer 1 can be made compact. In other words, if the guide rail 25 is provided on the platen side, i.e., the back surface side of the rolled sheet P, the printer 1 can not be made compact since the air suction unit 13 is already provided on the platen side.

Furthermore, as will be described below, the cutter unit 30 has a first cutter 37 and a second cutter 38 (refer to FIGS. 6 to 10), and is provided so as to be able to cut the rolled sheet P.

As described above, because the guide rail 25 is provided on the upper side, which is the recording surface side of the rolled sheet P, the dust generated during cutting of the rolled sheet P will not adhere to the guide rail 25. Thus, sliding noise will not increase at the guide rail 25. In addition, the durability of the guide rail 25 can be improved.

As shown in FIGS. 4 and 5, upstream-side auxiliary roller holders 50 are provided on the upstream side of the guide rail 25 in the feed direction. The upstream-side auxiliary roller holders 50 rotatably retain a plurality of upstream-side auxiliary rollers 51 arranged in the width direction X. The upstream-side auxiliary rollers 51 allow the rolled sheet P sent from the recording execution portion 4 to pass beneath the guide rail 25.

Even when the rolled sheet P is curved due to its having been rolled up and rises from the platen 11, the upstream-side auxiliary rollers 51 can restrain the rolled sheet P from rising and allow the rolled sheet P to pass beneath the guide rail 25.

Similarly, downstream-side auxiliary roller holders 52 are provided on the downstream side of the guide rail 25 in the feed direction. The downstream-side auxiliary roller holders 52 rotatably retain a plurality of downstream side auxiliary rollers 53 arranged in the width direction X. The downstream side auxiliary rollers 53 prevent the curved rolled sheet P, after cutting, from rising.

The upstream-side auxiliary rollers 51 and the downstream side auxiliary rollers 53 also serve an important function for safety. As will be described below, the cutter unit 30 has cutters 37 and 38. It is preferable that the cutters 37 and 38 be provided such that a user cannot touch them.

The provision of the upstream-side auxiliary rollers 51 and the downstream side auxiliary rollers 53 in the width direction X on the upstream and downstream sides of the guide rail 25, respectively, can prevent a user from touching the cutters 37 and 38. Furthermore, the provision of the downstream-side auxiliary roller holders 52 can prevent the user from touching the cutter carriage 32.

Figure 7B:
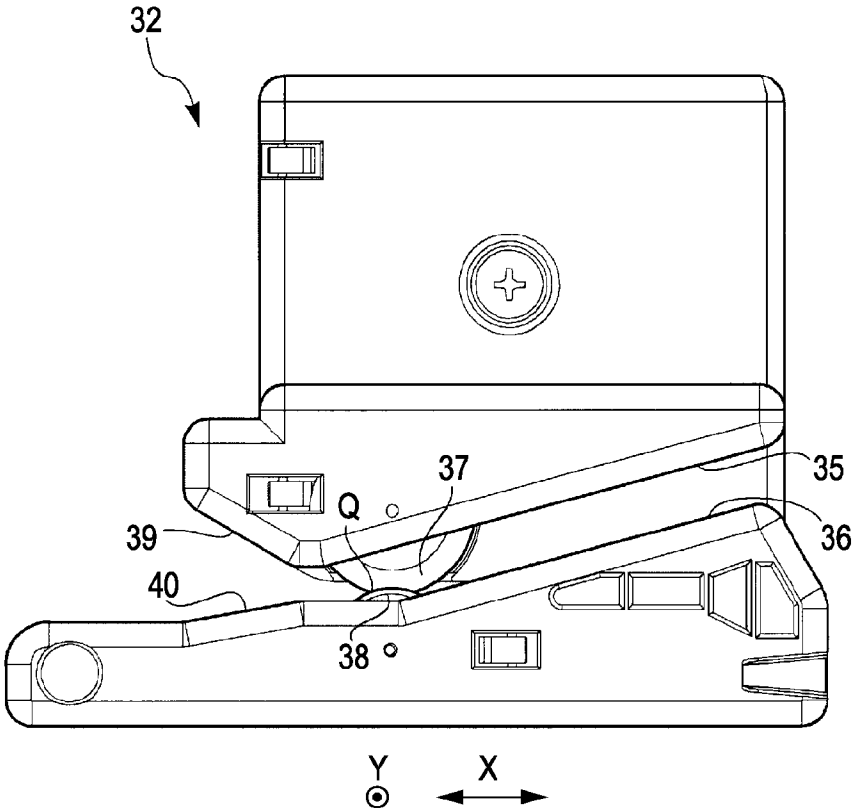
FIGS. 7A and 7B show a cutter carriage of the invention.
Figure 7A:
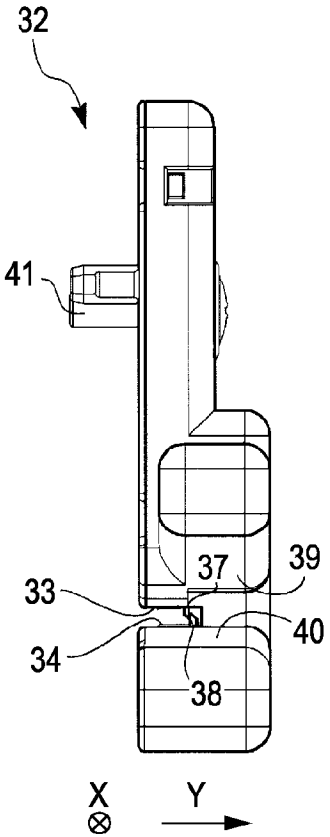
Figure 8B:
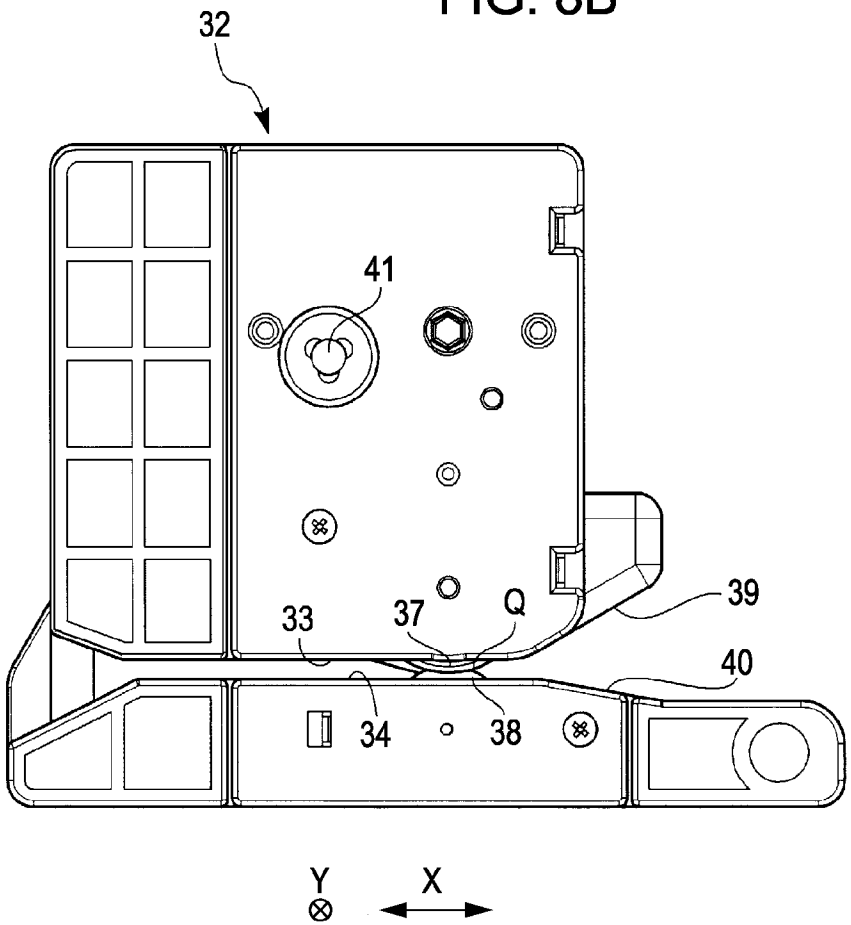
FIGS. 8A and 8B show the cutter carriage of the invention.
Figure 8A:
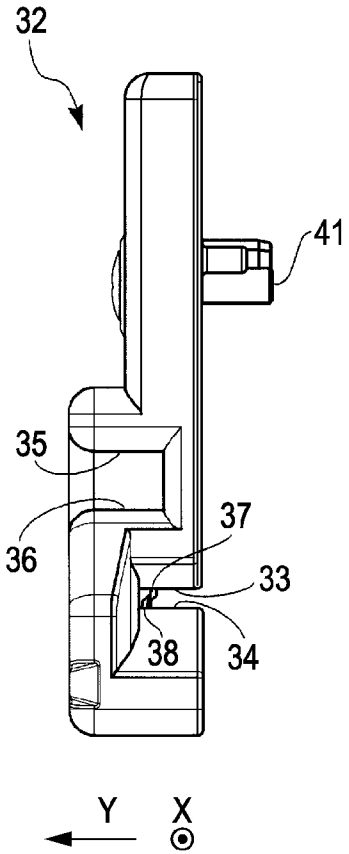

FIG. 6 is a perspective view showing the cutting section of the invention cutting a sheet. FIGS. 7A and 7B show a cutter carriage of the invention. FIG. 7A is a side view viewed from an 80-digit side, and FIG. 7B is a front view. FIG. 8A is a side view viewed from a 1-digit side, and FIG. 8B is a back view.

FIG. 9 is a back perspective view showing power transmission to the cutters of the cutter unit of the invention.

Figure 10:
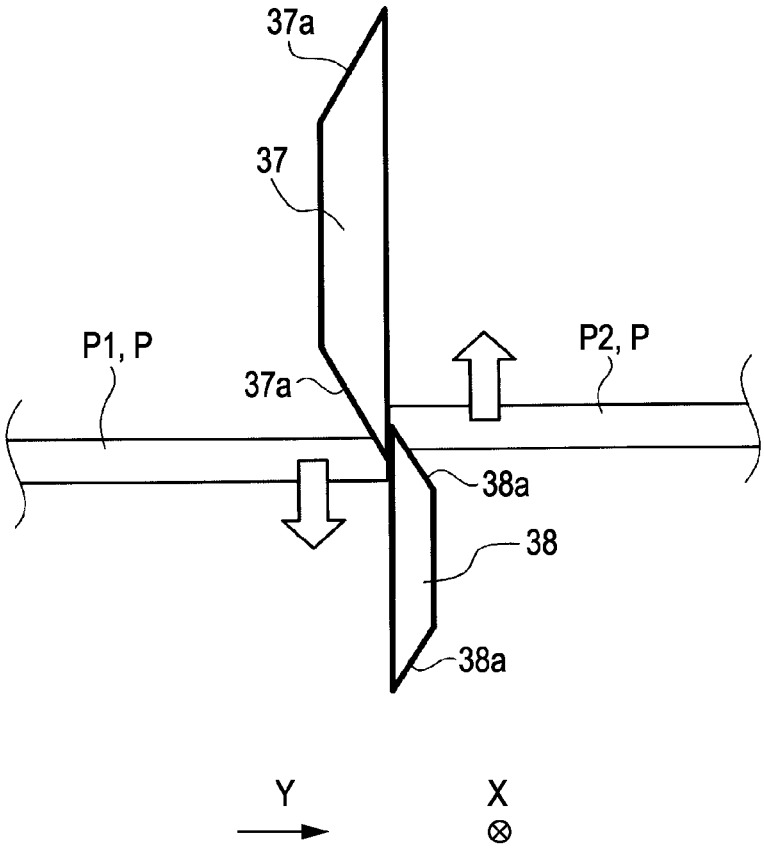
FIG. 10 is an enlarged side view showing the cutters of the invention cutting the sheet.

FIG. 10 is an enlarged side view showing the cutters of the invention cutting the sheet.

As shown in FIG. 6, the cutter unit 30 includes the cutter carriage 32 and a slider portion 31. The cutter carriage 32 has, as will be described below, the first cutter 37 and the second cutter 38. The slider portion 31 is provided so as to slide in the guide rail 25. More specifically, the endless belt 23 is wound around the driving pulley (not shown) provided on the cutter motor 22 on the 80-digit side and the driven pulley 24 on the 1-digit side. The slider portion 31 attached to and powered by the endless belt 23 slides in the width direction X.

The cutter unit 30 is provided so as to cut the rolled sheet P while moving from the 1-digit side to the 80-digit side. As the cutter unit 30 cuts the rolled sheet P, a second inclined portion 36 of the cutter carriage 32 pushes a rolled sheet, P2, to be positioned on the downstream side after cutting upwards, i.e., to the recording surface side. A first inclined portion 35 facing the second inclined portion 36 is inclined with respect to the width direction X so as not to come into contact with the recording surface of the rolled sheet P.

The cutter carriage 32 will be described below in detail.

As shown in FIGS. 7A, 7B, 8A, and 8B, the cutter carriage 32 has the first cutter 37 and the second cutter 38, which are round blades. The first cutter 37 is provided above the rolled sheet P, and the second cutter 38 is provided below (on the back surface side) of the rolled sheet P. The first cutter 37 and the second cutter 38 are configured to cut the rolled sheet P from above and below in cooperation with each other (refer to FIG. 10).

The first cutter 37 is provided on the upstream side of the second cutter 38 in the feed direction.

The cutter carriage 32 further has, on the downstream side in a cutting direction, a first pre-cut guide portion 39 and a second pre-cut guide portion 40 that guide the rolled sheet P to a cutting point Q.

Herein, the term "cutting direction" refers to a direction extending from the 1-digit side to the 80-digit side.

The term "cutting point" refers to a point at the downstream end of a region where the first cutter 37 and the second cutter 38 overlap each other in the cutting direction.

In the cutter carriage 32, the first pre-cut guide portion 39 is provided on the upper side, and the second pre-cut guide portion 40 is provided below the first pre-cut guide portion 39.

Therefore, even when the position of the rolled sheet P is varied in the front-back direction of the sheet, the rolled sheet P can be guided to the cutting point Q. As a result, the accuracy of the cutting position of the rolled sheet P can be improved. Furthermore, the first pre-cut guide portion 39 and the second pre-cut guide portion 40 can improve the accuracy of the cutting position of the rolled sheet P by cooperating with the above-described upstream-side auxiliary rollers 51 and the downstream side auxiliary rollers 53.

The distance between the first pre-cut guide portion 39 and the second pre-cut guide portion 40 is gradually reduced from the 80-digit side to the 1-digit side. Near the cutting point Q, the distance is reduced such that nothing but the rolled sheet P can reach the cutting point Q. Only predetermined sheet materials, such as a rolled sheet, fabric, and a film material, can reach the cutting point Q. Nothing else will touch the first cutter 37 and the second cutter 38. A user will not directly touch the cutting point Q. Accordingly, the safety can be ensured.

Furthermore, the cutter carriage 32 has a first guide surface portion 33, a second guide surface portion 34, the first inclined portion 35, and the second inclined portion 36 on the 1-digit side of the first pre-cut guide portion 39 and the second pre-cut guide portion 40. The first guide surface portion 33 is provided on the upstream side of the first cutter 37 and the second cutter 38 in the feed direction, at a position on the upper side. The second guide surface portion 34 is provided on the upstream side of the first cutter 37 and the second cutter 38 in the feed direction, at a position below the first guide surface portion 33. That is, the first guide surface portion 33 and the second guide surface portion 34 are opposed to each other. The first guide surface portion 33 and the second guide surface portion 34 are provided substantially parallel to the width direction X.

The first inclined portion 35 is provided on the downstream side of the first cutter 37 and the second cutter 38 in the feed direction, at a position on the upper side. The second inclined portion 36 is provided on the downstream side of the first cutter 37 and the second cutter 38 in the feed direction, at a position blow the first inclined portion 35. That is, the first inclined portion 35 and the second inclined portion 36 are opposed to each other. The first inclined portion 35 and the second inclined portion 36 are gradually inclined upward with respect to the width direction X, from the 80-digit side to the 1-digit side.

The cutter carriage 32 further has a transmission axis 41. The transmission axis 41 is provided in order to transmit a moving force to the first cutter 37 when the cutter carriage 32 is moved in the width direction X. Power transmission to the first cutter 37 will be described below.

As shown in FIG. 9, the cutter carriage 32 has a first gear 42, a second gear 43, a third gear 44, and a fourth gear 45. The first gear 42 is formed integrally with the transmission axis 41. The second gear 43 is engaged with the first gear 42. The third gear 44 is engaged with the second gear 43. The fourth gear 45 is formed integrally with the first cutter 37 and engaged with the third gear 44.

The slider portion 31 has a first slider pulley 46 and a second slider pulley 47 that hold an upper belt 23*a* of the endless belt 23 therebetween. The first slider pulley 46 is engaged with the transmission axis 41 of the cutter carriage 32.

The slider portion 31 is fixed to a lower belt 23*b* of the endless belt 23.

Thus, as shown in FIG. 9, when the cutter motor 22 is driven to pull the lower belt 23*b* to the 80-digit side, the slider portion 31 and the cutter carriage 32 move to the 80-digit side.

At this time, the upper belt 23*a* moves to the 1-digit side. The first slider pulley 46, powered by the upper belt 23*a*, is rotated counterclockwise and transmits power to the transmission axis 41. The transmission axis 41 transmits power via the first gear 42 to the second gear 43. The second gear 43 is rotated clockwise and transmits power via the third gear 44 to the fourth gear 45. Thus, the first cutter 37 is rotated clockwise.

As has been described, the movement of the cutter carriage 32 rotates the first cutter 37. In other words, the first cutter 37 is a driving blade. At this time, the speed at the circumference of the first cutter 37 is equal to or slightly higher than the moving speed of the cutter carriage 32. On the other hand, the second cutter 38 is rotated in a driven manner when cutting the rolled sheet P.

Because the first cutter 37 rotates in a driving manner, the rolled sheet P is caused to mesh with the cutting point Q of the first cutter 37 and the second cutter 38. In addition, because the first cutter 37 on the upper side rotates at the speed mentioned above, no slip occurs between the recording surface of the rolled sheet P and the outer circumference of the first cutter 37 when the rolled sheet P is cut.

As a result, the recording surface of the rolled sheet P, near the cut portion, will not be damaged. By allowing the rolled sheet P to drive the first cutter 37 on the recording surface side, the recording surface of the rolled sheet P will not be damaged.

As shown in FIG. 10, when the rolled sheet P is cut from above and below, a rolled sheet, P1, to be positioned on the upstream side after cutting and the rolled sheet, P2, to be positioned on the downstream side after cutting are subjected to forces in the top-bottom direction. More specifically, the rolled sheet P1 is subjected to a downward force by the first inclined surface 37*a* of the first cutter 37 and tends to be displaced downward.

On the other hand, the rolled sheet P2 is subjected to an upward force by the second inclined surface 38*a* of the second cutter 38 and tends to be displaced upward.

As described above, the air suction unit 13 is provided on the upstream side of the cutter carriage 32 in the feed direction. By activating the air suction unit 13, the rolled sheet P can be sucked toward the lower side, which is the platen side. Because the air suction unit 13 is activated during cutting of the rolled sheet P, the rolled sheet P to be cut can be accuracy positioned. As a result, accurate cutting is possible.

In addition, because the rolled sheet P1 is subjected to a downward force by the first inclined surface 37*a* of the first cutter 37, the effect of the air suction unit 13 will not be lessened. Because the rolled sheet P1 is displaced in a direction in which the air suction unit 13 sucks, the effect of the air suction unit 13 can be promoted. This is effective when the output of the air suction unit 13 is small.

As described above, the first guide surface portion 33 and the second guide surface portion 34 of the cutter carriage 32 are provided substantially parallel to the width direction X. Therefore, the rolled sheet P1 is guided while being in contact only with the second guide surface portion 34. That is, cutting is performed while the back surface of the rolled sheet P1 is pressed against the second guide surface portion 34. On the other hand, because the recording surface of the rolled sheet P1 is constantly separated from the first guide surface portion 33, the rolled sheet P1 will not be damaged.

Furthermore, as described above, the rolled sheet P2 tends to be displaced upward by the second inclined surface 38*a* of the second cutter 38.

The first inclined portion 35 and the second inclined portion 36 of the cutter carriage 32 are gradually inclined upward with respect to the width direction X, toward the 1-digit side. The first inclined portion 35 and the second inclined portion 36 are inclined gently so as not to prevent the rolled sheet P2 from being displaced upward by the second inclined surface 38*a* of the second cutter 38, while allowing the back surface of the rolled sheet P2 to be constantly in contact with the second inclined portion 36.

The distance between the first inclined portion 35 and the second inclined portion 36 is large enough such that the recording surface of the rolled sheet P2 will not come into contact with the first inclined portion 35.

Thus, the recording surface of the rolled sheet P2 can be constantly separated from the first inclined portion 35. Accordingly, the recording surface of the rolled sheet P2 will not be damaged.

The cutting section 20 according to this embodiment, serving as the cutter device, includes: the first cutter 37 provided on the front surface side, i.e., the recording surface side, of the rolled sheet P being fed, which is an example of a medium to be cut; the second cutter 38 that is provided on the back surface side opposite the recording surface side and cuts the rolled sheet P in cooperation with the first cutter 37; the cutter unit 30, serving as the carriage, which retains the first cutter 37 and the second cutter 38 and moves in the width direction X of the rolled sheet P; the guide rail 25, serving as the guide portion, which guides the cutter unit 30 in the width direction X; and the second inclined portion 36, serving as the post-cut guide portion, which is provided on the cutter carriage 32 of the cutter unit 30 and comes into contact with the back surface to guide the rolled sheet P on the downstream side of the first cutter 37 and the second cutter 38 in the feed direction of the rolled sheet P upwards, i.e., to the recording surface side.

In this embodiment, the first cutter 37 is provided on the upstream side of the second cutter 38 in the feed direction, and the second cutter 38 is provided on the downstream side of the first cutter 37 in the feed direction.

Furthermore, in this embodiment, the suction holes 14 in the air suction unit 13, serving as a suction portion and sucks the rolled sheet P toward the back surface side, are provided on the upstream side of the first cutter 37 and the second cutter 38 in the feed direction.

In this embodiment, the first cutter 37 and the second cutter 38 are round blades, and the first cutter 37 is driven by the movement of the cutter unit 30.

Furthermore, in this embodiment, the guide rail 25 is provided on the recording surface side of the rolled sheet P being fed.

In this embodiment, the upstream-side auxiliary rollers 51 and the downstream side auxiliary rollers 53, serving as the auxiliary rollers, which can come into contact with the rolled sheet P to be rotated in a driven manner, are provided on the upstream and downstream sides of the guide rail 25 in the feed direction Y.

Furthermore, in this embodiment, the cutter carriage 32 of the cutter unit 30 includes the first pre-cut guide portion 39 and the second pre-cut guide portion 40, serving as the pre-cut guide portions, which guide the rolled sheet P subjected to cutting to the cutting point Q where the first cutter 37 and the second cutter 38 overlap each other.

The ink jet printer 1 according to this embodiment, which is an example of a recording apparatus, includes the rolled-sheet feed section 3, serving as the feed section, which feeds the rolled sheet P as an example of the recording medium, the recording execution portion 4, serving as the recording section, which executes recording on the rolled sheet P fed from the rolled-sheet feed section 3 with the recording head 12, and the cutting section 20 that cuts the recorded rolled sheet P.

It is to be understood that the invention is not to be limited to the above-described embodiment, but may be modified within the scope of the appended claims.

What is claimed is:

1. A cutter device comprising:

a first cutter provided on a front surface side of a medium being fed to be cut;

a second cutter that is provided on a back surface side opposite the front surface side and cuts the medium in cooperation with the first cutter;

a carriage that retains the first and second cutters and moves in a width direction of the medium;

a guide portion that guides the carriage in the width direction; and a post-cut guide portion that is provided on the carriage and comes into contact with the back surface to guide the medium on the downstream side of the first and second cutters in a medium feed direction after cutting to the front surface side.

2. The cutter device according to claim 1, wherein the first cutter is provided on an upstream side of the second cutter in the feed direction, and wherein the second cutter is provided on a downstream side of the first cutter in the feed direction.

3. The cutter device according to claim 2, further comprising a suction portion that sucks the medium toward the back surface side at a position on the upstream side of the first and second cutters in the feed direction.

4. The cutter device according to claim 1, wherein the first and second cutters are round blades, and wherein the first cutter is driven by the movement of the carriage.

5. The cutter device according to claim 1, wherein the guide portion is provided on the front surface side.

6. The cutter device according to claim 1, further comprising auxiliary rollers provided on the upstream and downstream sides of the guide portion in the feed direction, the auxiliary rollers being capable of coming into contact with the medium and rotated in a driven manner.

7. The cutter device according to claim 1, wherein the carriage includes a pre-cut guide portion that guides the medium subjected to cutting to a cutting point where the first and second cutters overlap each other.

8. A recording apparatus comprising:

a feed section that feeds a recording medium;

a recording section that executes recording on the recording medium fed from the feed section with a recording head; and a cutting section that cuts the recording medium after recording, wherein the cutting section includes the cutter device according to claim 1.

9. The recording apparatus according to claim 8, wherein the first cutter is provided on an upstream side of the second cutter in the feed direction, and wherein the second cutter is provided on a downstream side of the first cutter in the feed direction.

10. The recording apparatus according to claim 9, further comprising a suction portion that sucks the medium toward the back surface side at a position on the upstream side of the first and second cutters in the feed direction.

11. The recording apparatus according to claim 8, wherein the first and second cutters are round blades, and wherein the first cutter is driven by the movement of the carriage.

12. The recording apparatus according to claim 8, wherein the guide portion is provided on the front surface side.

13. The recording apparatus according to claim 8, further comprising auxiliary rollers provided on the upstream and downstream sides of the guide portion in the feed direction, the auxiliary rollers being capable of coming into contact with the medium and rotated in a driven manner.

14. The recording apparatus according to claim 8, wherein the carriage includes a pre-cut guide portion that guides the medium subjected to cutting to a cutting point where the first and second cutters overlap each other.

15. The recording apparatus according to claim 8, wherein roller holders are provided on a downstream side of the guide portion in the feed direction and wherein the roller holders rotatably retain a plurality of downstream side rollers arranged in the width direction.

16. The recording apparatus according to claim 8, wherein an air suction section is provided on a downstream side of the recording section in the feed direction, the air suction section being provided on the upstream side of the cutting section.

* * * * *